US007596237B1

(12) United States Patent
Constantin

(10) Patent No.: US 7,596,237 B1
(45) Date of Patent: Sep. 29, 2009

(54) METHOD FOR CONTROLLING A TRANSMISSION SYSTEM, APPLICATION OF THE METHOD, A TRANSMISSION SYSTEM, A RECEIVER AND A HEARING AID

(75) Inventor: Jean-Claude Constantin, Granges-Paccot (CH)

(73) Assignee: Phonak AG, Stafa (CH)

( * ) Notice: Subject to any disclaimer, the term of this patent is extended or adjusted under 35 U.S.C. 154(b) by 759 days.

(21) Appl. No.: 09/664,273

(22) Filed: Sep. 18, 2000

(51) Int. Cl.
*H04R 25/00* (2006.01)

(52) U.S. Cl. ..... 381/314; 318/2

(58) Field of Classification Search ..... 381/2, 381/312–315, 60, 1, 316; 455/41.1, 39, 78, 455/550.1

See application file for complete search history.

(56) References Cited

U.S. PATENT DOCUMENTS

| | | | | | |
|---|---|---|---|---|---|
| 5,133,081 | A * | 7/1992 | Mayo | 455/18 |
| 5,257,099 | A * | 10/1993 | Morales-Garza | 725/65 |
| 5,479,522 | A | 12/1995 | Lindemann et al. | |
| 5,710,819 | A * | 1/1998 | T.o slashed.pholm et al. | 381/316 |
| 5,721,783 | A * | 2/1998 | Anderson | 381/328 |
| 5,734,976 | A * | 3/1998 | Bartschi et al. | 455/333 |
| 5,751,820 | A * | 5/1998 | Taenzer | 381/312 |
| 5,812,598 | A * | 9/1998 | Sharma et al. | 375/259 |
| 6,091,826 | A * | 7/2000 | Laitinen et al. | 381/82 |
| 6,424,722 | B1 * | 7/2002 | Hagen et al. | 381/314 |
| 6,463,128 | B1 * | 10/2002 | Elwin | 379/52 |
| 2002/0016188 | A1 * | 2/2002 | Kashiwamura | 455/568 |

FOREIGN PATENT DOCUMENTS

| | | | |
|---|---|---|---|
| FR | 2 781 623 | | 1/2000 |
| WO | WO 97/29550 | * | 8/1997 |
| WO | WO 98/00997 | * | 1/1998 |
| WO | WO 99/03254 | * | 1/1999 |

* cited by examiner

*Primary Examiner*—Xu Mei
*Assistant Examiner*—Lun-See Lao
(74) *Attorney, Agent, or Firm*—Pearne & Gordon LLP

(57) ABSTRACT

The invention relates to a method controlling a transmission system composed of at least one transmitter ($1 . . . Sn) and at least one receiver (1), a signal ($S_{in}$) which is modulated in amplitude, frequency and/or phase being transmitted through an information channel (120). In the invention, configuration parameters are transmitted through a control channel (110 . . . 113) to the receiver (1), said transmission through said control channel (110 . . . 113) being independent of any transmission implemented through the information channel (120). On the basis of the transmitted configuration parameters, adjustments are implemented in the receiver (1), in particular relating to demodulating the signal ($S_{in}$) transmitted through the information channel. The invention furthermore relates to method applications, to a transmission system, to a receiver and to a hearing aid.

20 Claims, 3 Drawing Sheets

METHOD FOR CONTROLLING A TRANSMISSION SYSTEM, APPLICATION OF THE METHOD, A TRANSMISSION SYSTEM, A RECEIVER AND A HEARING AID

The present invention relates to a method for controlling a transmission system defined in the preamble of claim 1, further to application of the method, to a transmission system, to a receiver and to a hearing aid.

Miniaturized FM (frequency-modulated) transmission systems have been used already for a considerable time with hearing aids. Essentially the transmission system consists of a microphone-fitted transmitter and a receiver connected to the hearing aid. It is critically important that the receiver per se be as compact and as lightweight as possible in order that the unit consisting of receiver and hearing aid be of a size readily tolerated by its wearer.

A receiver of the cited kind is known from the U.S. Pat. No. 5,734,976 and uses FM transmission wherein the carrier frequency is set by a quartz crystal.

As a result this known state of the art incurs the drawback that changing the carrier frequency, and hence the transmission channel, entails exchanging the quartz crystal. Therefore this system precludes rapidly switching between different transmission channels. Moreover the known system is a drawback for the hearing-aid manufacturer because a large number of quartz crystals must be kept in stock in order to allow switching between transmission channels in a reasonably short time.

Accordingly it is the object of the present invention first to create a method allowing rapidly switching from one transmission channel to another. At the same time the switchover between different transmission channels shall not cause interferences in the audio signal.

This problem is solved by the steps stated in claim 1. Advantageous embodiments of the invention, namely method application, a transmission system, a receiver and a hearing aid are stated in further claims.

The invention offers the following advantages: Problem-free and interference-less switching from a signal which is modulated in amplitude, frequency and/or phase to another signal can be implemented by adjusting configuration parameters in the receiver. Because of the low transmission rate, the control channel may be of low power compared with the information channel. As a result the control channel does not require a special authorization procedure and the required components can be put together in exceedingly economical manner.

Also, by using a synthesizer in the receiver to generate the frequencies required to demodulate the received signals, extremely rapid and flexible matching to the employed carrier frequencies is made possible and consequently rapid switching from one information channel to another is assured.

The invention is elucidated in illustrative manner below in relation to the attached drawings.

Figure 1:
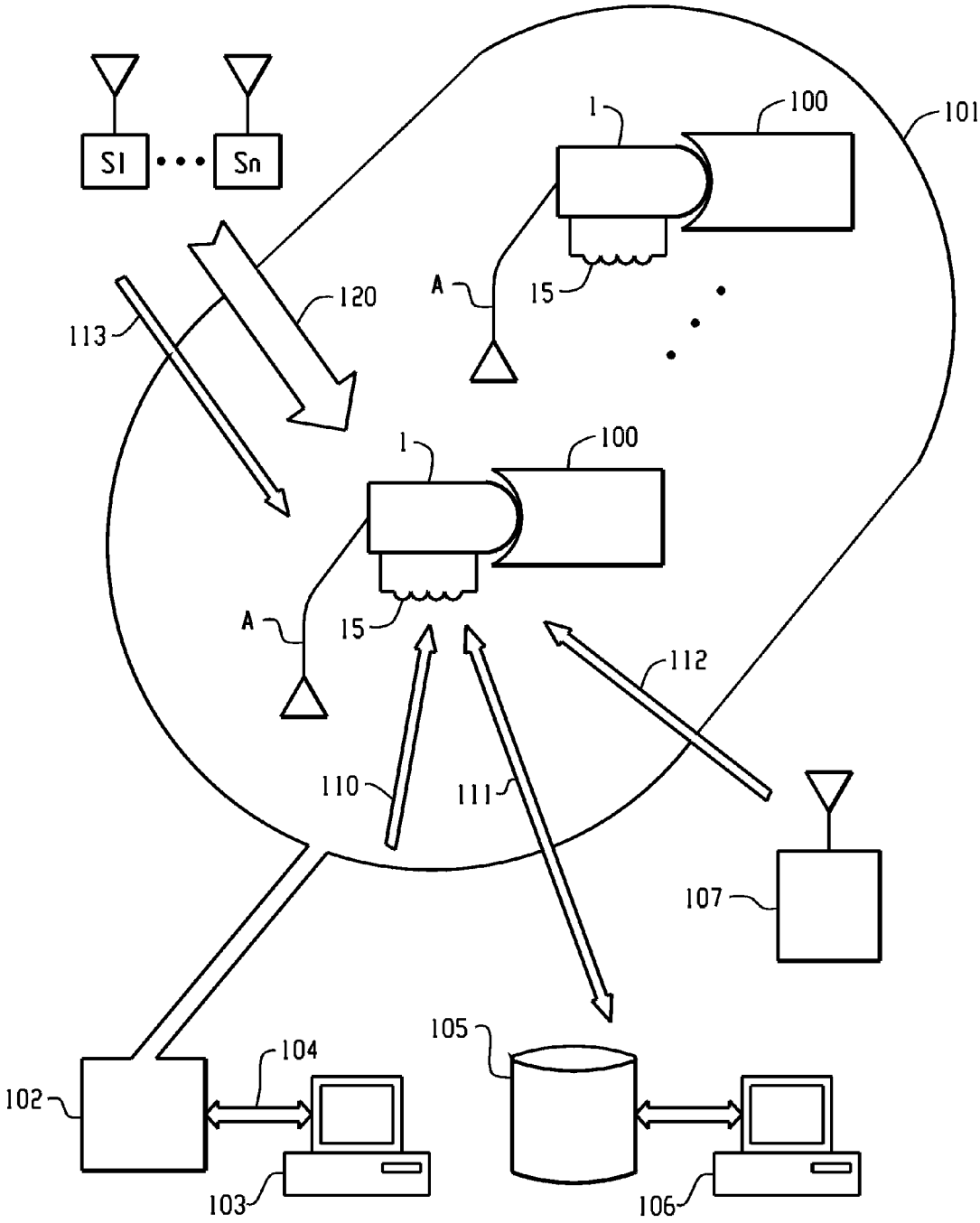
Figure 2:
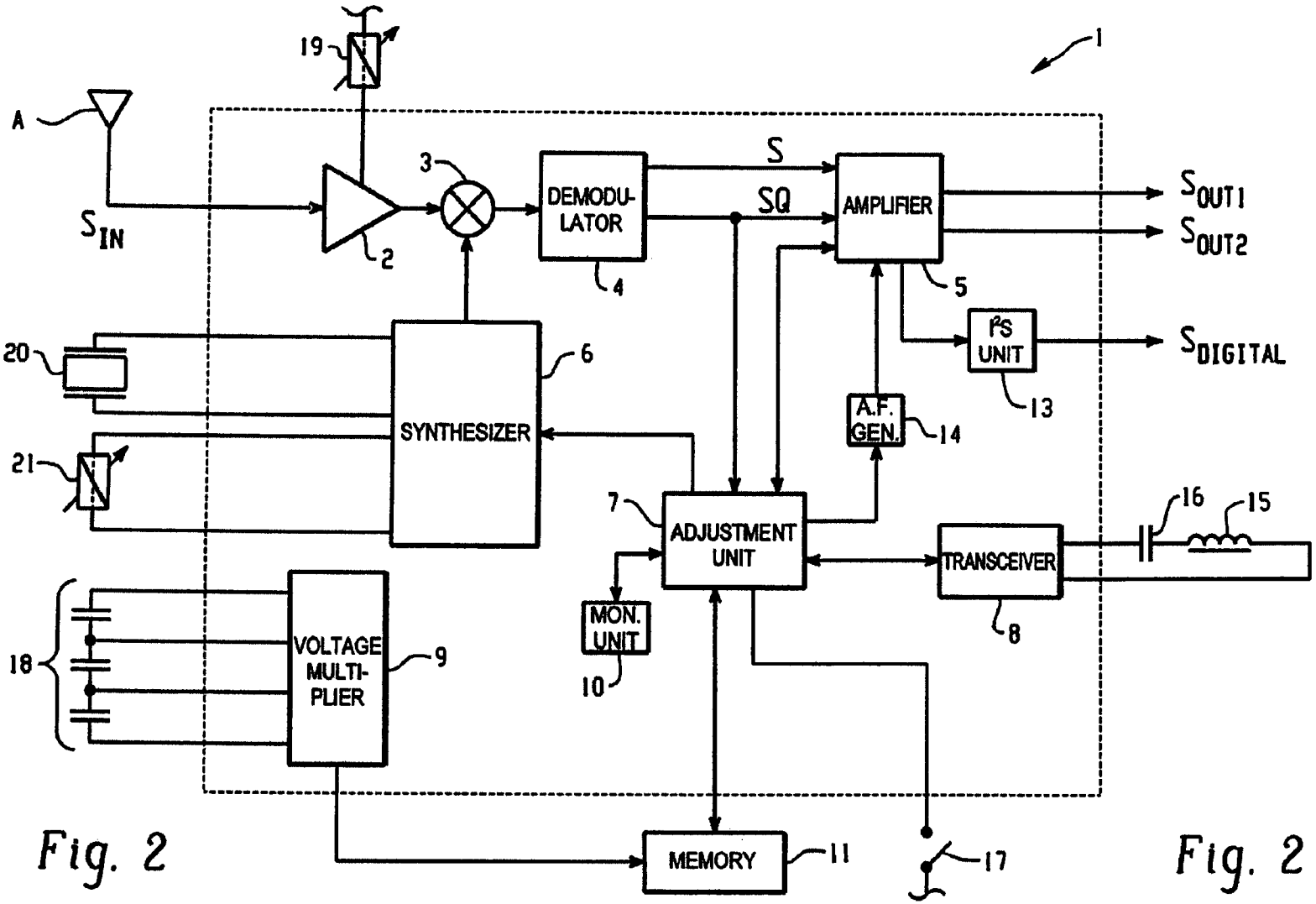
Figure 3:
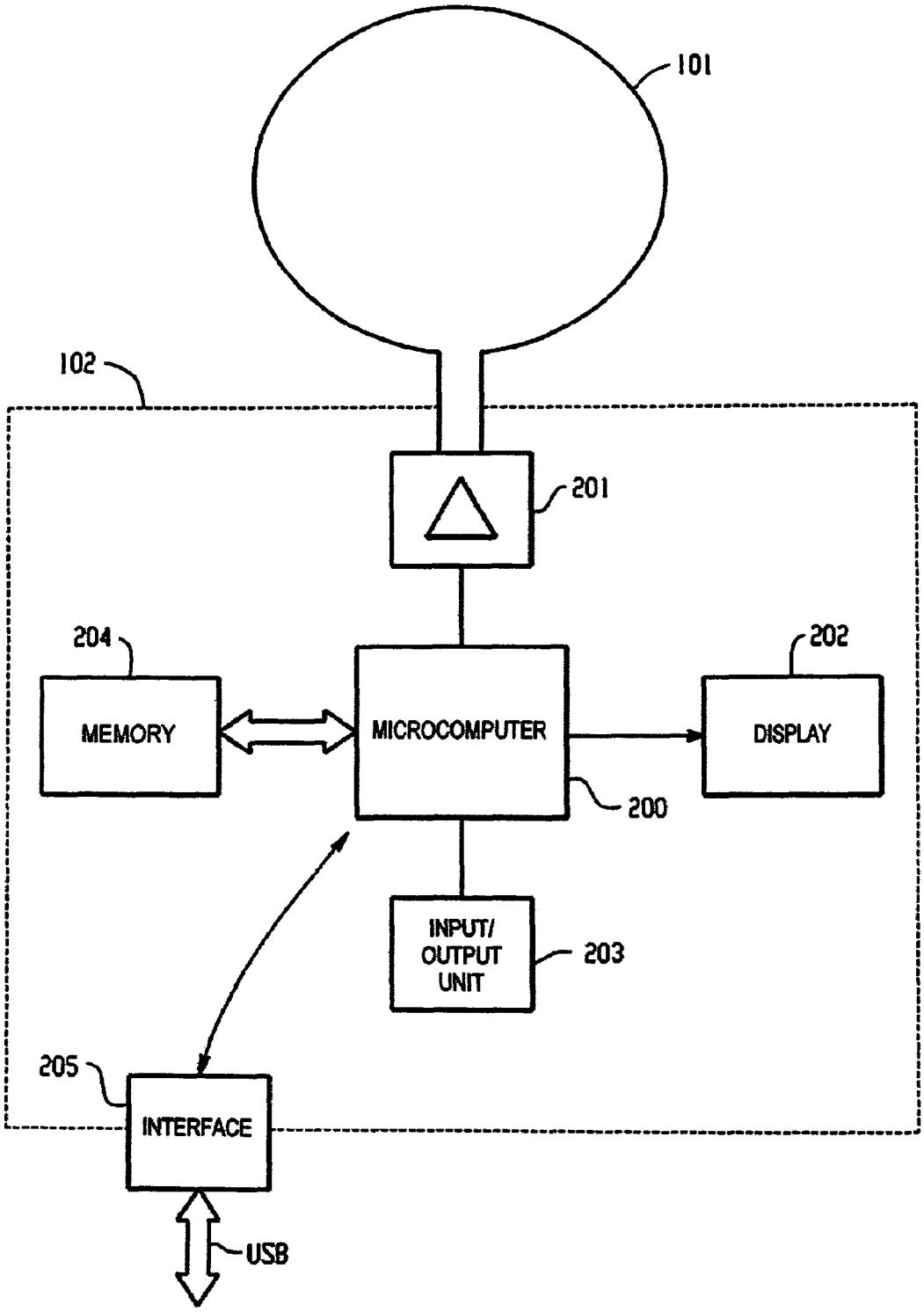

FIG. 1 schematically shows a transmission system of the invention with a receiver, FIG. 2 is a functional block diagram of the receiver of the invention of FIG. 1, and FIG. 3 is a control unit used in the transmission system of FIG. 1.

FIG. 1 diagrammatically shows a transmission system of the invention consisting of a set of components required according to application or mode of operation.

Part of the transmission system are a transmitter S1 . . . Sn and a receiver 1 which are connected by a radio link hereafter called the information channel 120. If, as in the present case, the signal being transmitted is an audio signal, then this signal shall be modulated at a carrier frequency in the transmitter S1 . . . Sn prior to transmission, for instance using known amplitude, frequency and/or phase modulation. Obviously depending on the transmission power being used and the particular carrier frequency, the information channel 120 also is suitable for long-range transmission or transmission through buildings. Known applicable modulation procedures illustratively are described in ELECTRONIC ENGINEERS HANDBOOK (D Christansen, $4^{th}$ ed., McGraw-Hill, chapter 18).

The presence of n transmitters S1 . . . Sn indicates that various audio signals to be transmitted are modulated at different carrier frequencies so that different audio signals can be received in one receiving zone provided there be corresponding tuning to the particular carrier frequency in the receiver 1. Conceivably however merely one transmitter is used instead of the n S1 . . . Sn transmitters, where said single transmitter is fitted with several, preferably n transmission channels. The principle of the invention also covers this different embodiment of transmitter design. Either design shall be implied hereafter where n transmitters S1 . . . Sn are mentioned.

In order to tune the receiver 1 to one of the transmitters S1 . . . Sn and hence to a particular audio signal, the transmission system of the invention comprises a control channel 110, 111, 112, 113 transmitting configuration parameters corresponding to the particular transmitter S1 . . . Sn to the receiver 1. For that purpose the transmitters S1 . . . Sn have access within themselves or in separate components to corresponding means generating and transmitting the configuration parameters. Illustratively such means may be selectively a control unit 102 and/or a remote control 107. As regards communication—that is regarding the control channel—between receiver 1 and control unit 102 or remote control 107, they also are wireless and are indicated by the references 110 and 112 resp. in FIG. 1. If the transmitters S1 . . . Sn themselves are fitted with corresponding means generating and transmitting the configuration parameters, then said parameters shall be transmitted through the control channel 113 to the receiver 1. Be it borne in mind that even though according to FIG. 1 various control channels are conceivable—such as referenced 110 through 113 in FIG. 1—as regards transmission principles they are one and the same transmission channel because latter's specifications such as rate of transmission and carrier frequency preferably remain unchanged for one and the same transmission system.

In a preferred embodiment of the invention, frequency-shift keying (FSK) modulation is used in the control channel, the transmission rate being 1,280 bits/s and the channel center frequency being 40,960 kHz.

Switching, i.e. tuning to a specific carrier frequency and hence to a given audio signal, is not initiated in the receiver 1 per se in the present invention, but instead and in preferred manner by using one of control channels 110, 112, 113. In the preferred embodiment of the transmission system of the invention, the information channel 120 used by the audio signal in no way shall transmit any other data. On one hand this feature allows switching from one audio signal to another without requiring manual adjustments in the receiver 1. On the other hand the receiver 1 can be remote-controlled, allowing wide applicability of the transmission system of the invention as discussed below.

A configuration unit 105 furthermore is provided in the transmission system of the invention enabling again to configure/program the receiver 1 and any further components connected to said receiver 1 through a wireless link 111

(control channel). Because, in the configuration phase, the receiver 1 can be positioned near the configuration unit 105, comparatively few demands are placed on the link 111, that is, satisfactory data transmission can be carried out at low transmitting power. This feature is especially critical because, as shown in FIG. 1, the link 11 is bidirectional and furthermore and in particular as regards a miniaturized receiver 1, only very little energy is available inside the receiver 1 in the sending mode.

A computer unit 106, for instance a commercial PC, is used as an input and processing accessory to program the receiver 1. As a result it is possible to manage the entire transmission system, new program drivers in particular being downloaded into the receiver 1. By means of back-transmitting, it is possible for instance to feed version data from the receiver 1 through the configuration unit 105 to the computing unit 106 where they shall be processed further.

As regards the application shown in FIG. 1, the receiver 1 is detachably connected to a hearing aid 100. All functions relating to radio signal transmission are implemented in the receiver 1. Because of different requirements on the rate of signal transmission and range of transmission when transmitting audio signals and when transmitting control signals, the receiver 1 is fitted with two antennas, namely an antenna A for audio signals, and a receiving coil of substantially smaller dimensions for the control signals.

As shown by FIG. 1, the control unit 102 is connected on one hand to a loop antenna 101 and on the other hand to an input-computing unit 103. Said unit 103 again is used only for data input and preferably is in the form of a commercial personal computer (PC) and in this case communication between the control unit 102 and the input/computing-unit 103 takes place for instance through a standardized universal serial bus (USB).

Whereas the control unit 102 connected to the loop antenna 101 is used to transmit low-power control signals to the receiver 1, the remote control 107 is used to transmit control signals over short distances, again at low transmitting power. The various embodiments are elucidated in the applications described below.

The main application of the present invention concerns a transmission system in which the receiver 1 is linked to a hearing aid 100, and as a result the potential users are not restricted to the hearing-impaired but also cover people with normal hearing.

It is highly significant in the present invention that the user of the hearing aid 100, which is coupled to the receiver 1 of the invention, need not tune this aid to a given channel, including a particular carrier frequency, or ascertain which signal processing is required in order to receive and hear the desired audio signal, because these steps are implemented by the receiver 1 which shall be configured by the configuration parameters picked up by the receiving coil 15. The needed configuration parameters are transmitted from the control unit 102, from the remote control 107 or from one of the transmitters S1 . . . Sn directly through a universal communications link, that is the control channel 110 or 112 or 113 to the receiver 1, without interfering with a transmitted audio signal. The control channel 110 or 111 or 113 is operable only over short distances and comprises its own modulation procedure at a carrier frequency in agreement with international standards. In Europe this is the EN 300 330 standard (Radio Equipment and Systems; short range devices technical characteristic and test methods for radio equipment in the range of 9 kHz to 25 MHZ and inductive loop systems in the frequency range of 9 kHz to 30 MHZ) and in the USA it is the Code of Federal Regulations standard 47 (Telecommunication FCC Part 15, subpart C: Intentional Radiators) apply.

In a preferred embodiment of the invention, the following parameters are transmitted through the control channel 110 or 111, or 113:

the carrier frequency of a desired audio signal, a switching signal to complete turn OFF the receiver 1, a switching signal causing the received audio signal to be superposed on a microphone signal within the hearing aid, a "mute" command to turn OFF the audio signal, a signal controlling the volume of the received audio signal.

The receiver 1 is configured on the basis of all or some configuration parameters exclusively transmitted through the control channel 110 through 113.

As shown by FIG. 1, the control channel 110 through 113 is used in the following cases:

In the first place by means of the remote control 107 operated by the user to control the receiver 1 in the hearing aid 100 of the transmission system of the invention.

In the second place by means of the control unit 102 connected to the loop antenna 101, whereby each user. i.e. this user's receiver 1 is provided with the particular configuration parameters if within the detection range of the loop antenna 101. One or more codes are assigned to each user so that the users may be addressed singly or in groups. Such a transmission system is used in particular in schools where all the advantages of automatic adjustment will apply, in particular the fact that knowledge of the transmission channel (carrier frequency etc.) is not required. Further applications are conceivable to assembly spaces, for instance conference rooms, churches or railway stations: As soon as such a space is being entered, the hearing-aid receiver is automatically tuned to transmission channel of said assembly place.

Be it mentioned in this respect that in a further embodiment, the hearing aid is replaced with merely an electro-acoustic transducer coupled to the receiver. In this instance the various functions offered by a hearing aid are not available.

In the third place, the control channel is used to transmit data which shall be stored in a memory of the receiver, that is, the receiver, i.e. its memory, can be programmed through the control channel.

In a preferred embodiment of the invention, individual or several transmitters S1 through Sn are fitted with a transmitter generating a control signal or they transmit the configuration parameters. The transmitted configuration parameters are code-enhanced and this code causes a specifically addressed receiver 1 to configure according to the configuration parameters.

FIG. 2 is a functional block diagram of a receiver 1 of the invention detachably connected in the manner shown in FIG. 1 to a hearing aid 100.

A frequency or phase modulated signal $S_{in}$ is received by an antenna and first is fed to a filter/amplifier unit 2 fitted with an externally connected adjusting unit 19 to tune to the desired frequency band. The output of the filter/amplifier unit 2 is connected to the input of a mixer 3. A second input of the mixer 3 is connected to the output signal from a synthesizer 6 that shall be discussed further below. A demodulator 4 is connected to and follows the mixer 3 together with which it generates a demodulated signal S which is fed to an amplifier 5 adjusted by an adjustment unit 7. The output signals $S_{out1}$ and $S_{out2}$ were matched in the amplifier 5 and are fed either directly to a loudspeaker or to a hearing aid (omitted from FIG. 2).

In one embodiment variation of the receiver 1 of the invention, an $I^2S$ unit 13 is connected to the amplifier 5. The $I^2S$ unit 13 is an interface to control a digital 3-conductor bus. Reference is made in this respect to applicant's international patent application PCT/CH99/00009 with publication #WO 99/13699. Said application is an integral part of the present one. The $I^2S$ unit 13 comprises a digital output from which a digital audio signal $S_{digital}$ is fed back for instance directly to the hearing aid 100 (FIG. 1).

Also an audio-frequency generator 14 is provided and connected to the amplifier 5 generating a signal to be superposed on the signal S. In this manner a given state of the receiver 1, for instance low battery-voltage or setting at the standard carrier frequency can be acoustically communicated to the user. To receive corresponding control signals, the audio-frequency generator 14 is connected to the adjustment unit 7 which shall be elucidated below.

The transceiver coil already discussed in relation to FIG. 1 is denoted by 15 and receives the configuration parameters through the so-called separate control channel. To tune this transceiving coil 15 operating as an antenna, a series capacitor 16 follows said coil and preferably shall be variable. The transceiver coil 15 and the capacitor 16 are connected to a transceiver 8 which in turn is connected to the adjustment unit 7.

The adjustment unit 7 constitutes the real control center of the receiver 1 and besides the already mentioned components, namely the amplifier 5, the audio-frequency generator 14 and transceiver 8 additionally controls the synthesizer 6 wherein the mixed frequencies used in the mixer 3 are generated, and a monitoring unit 10 monitoring and optimizing the energy budget in the receiver 1, as a result of which the longest possible and most problem-free operation is assured.

The adjustment unit 7 assumes sequence control and further data from a memory 11 connected through a bus system to the adjustment unit 7. The memory 11 is non-volatile and programmable, for instance an EEPROM (electrically erasable programmable read-only memory). It is well known that higher voltages are required to program such memories than are typically needed by the other components. For that reason a voltage multiplier 9 with capacitors 18 is employed. Such a design attains voltages as high as several times that of the basic source.

Most of the components shown in FIG. 2 are contained within a box shown in dashed lines. Those are the components which preferably are integrated onto a chip in applicable CMOS technology. All other components such as the capacitors 18, the antenna A, the transceiving coil 15, the adjusting unit 21 etc. are outside the integrated circuit to which they are connected by appropriate terminals. The memory 11 is included in latter components and in practice has been exposed to severe overloads and therefore its life is shorter than that of the other components.

Lastly a single switch 17 driven by the user is present at the receiver 1 to initiate for instance the following functions:

By "briefly" closing the switch 17, the following operational modes will be switched between each other:

"transmit the audio signal", "audio signal with superposed microphone signal", and "no audio signal" [toggle mode], By closing the switch for a "long time", and after receiving the audio signals, the frequency band is scanned [scan mode], By closing the switch of a "very long time", the receiver 1 is disconnected; by closing the switch 17 again, the receiver 1 is re-connected.

The above functions or their transitions can be initiated by means of the remote control 107, the transmitter S1 through Sn or as called for also by means of the control unit 102 (FIG. 2).

In order to minimize energy consumption in the receiver 1, steps are taken in the demodulator 4 in addition to those carried out by the monitoring unit 10. Illustratively the amplifier 5 is automatically squelched as soon as the demodulator 4 ascertains that an audio signal no longer is being received. This state is transmitted by the adjustment unit 7 and the amplifier 5 through the connection SQ and as a result the components demodulating the transmitted audio signal $S_{in}$ can be deactivated. As a result the energy consumption drops as desired in the receiver 1. At the same time any noise shall be eliminated because being not at all transmitted to the subsequent hearing aid 100 (FIG. 1).

FIG. 3 is a functional block diagram of a control unit 102 connected to a loop antenna 101 of FIG. 1. Substantially the control unit 102 consists of a microcomputer 200 which is radially connected to a memory 204, an input/output unit 203, a display 202, a modulator 201 and an interface 205. Preferably the interface 205 is designed to drive an USB (universal serial bus) type bus system.

In a further embodiment of the invention, data correcting the transfer function of the information channel are fed to the receiver 1. Such correction information is ascertained by calculating a desired total transfer function of the information channel based on the uncorrected total transfer function. In this manner any undesired characteristics of the original total transfer function can be corrected.

It is hereby emphasized again that even though the receiver of the invention and the transmission system of the invention were discussed with respect to an illustrative hearing aid, application in no way is restricted to such a field. Instead the invention is applicable to arbitrary fields wherein information channels must be controlled.

The invention claimed is:

1. A wireless transmission system comprising:

a plurality of hearing devices, each hearing device comprising a signal processing unit and an electro-acoustic transducer, the signal processing unit being operatively connected to the electro-acoustic transducer;

means for transmitting a plurality of audio signals to the hearing devices, wherein each audio signal is transmitted at a configured carrier frequency;

each hearing device further comprising means for receiving at least one of the plurality of audio signals, said means for receiving at least one of the plurality of audio signals being operatively connected to at least one of the signal processing unit and the electro-acoustic transducer;

means for remotely generating and wirelessly transmitting configuration parameters to the hearing devices, for configuring the means for receiving at least one of the plurality of audio signals;

each hearing device further comprising means for receiving said configuration parameters, said means for receiving said configuration parameters being comprised in said means for receiving at least one of the plurality of audio signals; and each hearing device further comprising means for tuning the means for receiving at least one of the plurality of audio signals to an audio signal according to the configuration parameters, wherein the plurality of audio signals as well as the configuration parameters are transmitted wirelessly via independent transmission channels, whereby the configuration parameters are transmitted at a predefined carrier frequency via a common transmission channel shared by all said means for remotely generating and wirelessly transmitting configuration parameters and all said means for receiving the configuration parameters.

2. The wireless transmission system as claimed in claim 1, wherein the means for remotely generating and wirelessly transmitting the configuration parameters are provided in at least one of a remote control, a transmitter, a control unit connected to a loop antenna, and a configuration unit.

3. The wireless transmission system as claimed in claim 1, wherein the means for transmitting a plurality of audio signals consist of a single unit.

4. The wireless transmission system as claimed in claim 1, wherein the means for transmitting a plurality of audio signals consist of a plurality of units, each being able to transmit one audio signal.

5. The wireless transmission system as claimed in claim 1, further comprising a transmission unit containing the means for remotely generating and wirelessly transmitting the configuration parameters as well as the means for transmitting the plurality of audio signals.

6. The wireless transmission system as claimed in claim 1, further comprising a configuration unit containing the means for remotely generating and wirelessly transmitting the configuration parameters, wherein the configuration unit is capable of establishing a bidirectional communication link to the means for receiving the configuration parameters allowing programming of at least one of the hearing devices.

7. The wireless transmission system as claimed in claim 6, further comprising a computer unit that is operationally connected to the configuration unit.

8. The wireless transmission system as claimed in claim 1, further comprising a control unit that is, on one side, connected to a loop antenna and, on another side, connected to a input/computing unit.

9. The wireless transmission system as claimed in claim 8, wherein the input/computing unit is connected via a Universal Standard Bus to the control unit.

10. The wireless transmission system as claimed in claim 1, wherein at least one of the hearing devices includes at least one hearing aid adapted to be worn by a user.

11. A wireless transmission system comprising: a plurality of hearing devices, each hearing device comprising a signal processing unit and an electro-acoustic transducer, the signal processing unit being operatively connected to the electro-acoustic transducer; means for transmitting a plurality of audio signals to the hearing devices, wherein each audio signal is transmitted at a predefined carrier frequency; each hearing device further comprising means for receiving at least one of the plurality of audio signals, said means for receiving at least one of the plurality of audio signals being removeably mechanically coupled to the at least one hearing device, and said means for receiving at least one of the plurality of audio signals being operatively connected to at least one of the signal processing unit and the electro-acoustic transducer; means for remotely generating and wirelessly transmitting configuration parameters to the hearing devices, for configuring the means for receiving at least one of the plurality of audio signals; each hearing device further comprising means for receiving the configuration parameters, said means for receiving the configuration parameters being comprised in said means for receiving at least one of the plurality of audio signals; and each hearing device further comprising means for tuning the means for receiving at least one of the plurality of audio signals to an audio signal according to the configuration parameters, wherein the plurality of audio signals as well as the configuration parameters are transmitted wirelessly via independent transmission channels, whereby the configuration parameters are transmitted at a redefined carrier frequency via a common transmission channel shared by all said means for remotely generating and wirelessly transmitting configuration Parameters and all said means for receiving the configuration parameters.

12. The wireless transmission system as claimed in claim 11, wherein the means for remotely generating and wirelessly transmitting the configuration parameters are provided in at least one of a remote control, a transmitter, a control unit connected to a loop antenna, and a configuration unit.

13. The wireless transmission system as claimed in claim 11, wherein the means for transmitting a plurality of audio signals consist of a single unit.

14. The wireless transmission system as claimed in claim 11, wherein the means for transmitting a plurality of audio signals consist of a plurality of units, each being able to transmit one audio signal.

15. The wireless transmission system as claimed in claim 11, further comprising a transmission unit containing the means for remotely generating and wirelessly transmitting the configuration parameters as well as the means for transmitting the plurality of audio signals.

16. The wireless transmission system as claimed in claim 11, further comprising a configuration unit containing the means for remotely generating and wirelessly transmitting the configuration parameters, wherein the configuration unit is capable of establishing a bidirectional communication link to the means for receiving the configuration parameters allowing programming of at least one of the hearing devices.

17. The wireless transmission system as claimed in claim 16, further comprising a computer unit that is operationally connected to the configuration unit.

18. The wireless transmission system as claimed in claim 11, further comprising a control unit that is, on one side, connected to a loop antenna and, on another side, connected to a input/computing unit.

19. The wireless transmission system as claimed in claim 18, wherein the input/computing unit is connected via a Universal Standard Bus to the control unit.

20. The wireless transmission system as claimed in claim 11, wherein at least one of the hearing devices includes at least one hearing aid adapted to be worn by a user.

* * * * *

UNITED STATES PATENT AND TRADEMARK OFFICE

CERTIFICATE OF CORRECTION

PATENT NO. : 7,596,237 B1
APPLICATION NO. : 09/664273
DATED : September 29, 2009
INVENTOR(S) : Jean-Claude Constantin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1081 days.

Signed and Sealed this

Twenty-eighth Day of September, 2010

David J. Kappos

David J. Kappos
*Director of the United States Patent and Trademark Office*